US005752980A

United States Patent [19]

Pedersen et al.

[11] Patent Number: 5,752,980

[45] Date of Patent: May 19, 1998

[54] BLEACHING PROCESS COMPRISING USE OF PHENOL OXIDIZING ENZYME, A HYDROGEN PEROXIDE SOURCE AND AN ENHANCING AGENT

[75] Inventors: Anders Hjelholt Pedersen, Lyngby; Jesper Vallentin Kierulff, Valby, both of Denmark

[73] Assignee: Novo Nordisk A/S, Bagsvaerd, Denmark

[21] Appl. No.: 776,901

[22] PCT Filed: Oct. 18, 1995

[86] PCT No.: PCT/DK95/00417

§ 371 Date: Feb. 4, 1997

§ 102(e) Date: Feb. 4, 1997

[87] PCT Pub. No.: WO96/12845

PCT Pub. Date: May 2, 1996

[30] Foreign Application Priority Data

Oct. 20, 1994 [DK] Denmark ..... 1217/94

[51] Int. Cl.[6] ..... D06P 3/02; C11D 3/386

[52] U.S. Cl. ..... 8/111; 8/102; 8/107; 510/303; 510/305; 510/306; 510/367; 510/369; 510/392; 510/393; 252/8.91; 435/263

[58] Field of Search ..... 8/102, 107, 111; 510/305, 306, 303, 367, 369, 392, 393; 252/8.91; 435/263

[56] References Cited

U.S. PATENT DOCUMENTS 5,605,832 2/1997 Damhus et al. ..... 435/263

FOREIGN PATENT DOCUMENTS

WO 89/09813 10/1989 WIPO .
WO91/05839 5/1991 WIPO .
WO92/18683 10/1992 WIPO .

OTHER PUBLICATIONS

Kawai et al, "Oxidation of Methoxylated Benzyl Alcohols by Laccase of *Coriolus versicolor* in the presence of Syringaldehyde", *Wood Research*, 76, 1989, pp. 10–15.

Kato, et al., Plant Cell Physiology, vol. 26 (7), 1985 (Month Unknown).

Patent Abstract of Japan, Mar. 20, 1995, Japanese 070765547, Kobayashi, et al.

*Primary Examiner*—Alan Diamond
*Attorney, Agent, or Firm*—Steve T. Zelson, Esq.; Cheryl H. Agris, Esq.

[57] ABSTRACT

The present invention relates to a process for providing a bleached look in the color density of the surface of dyed fabric, especially cellulosic fabric such as denim, comprising use of a phenol oxidizing enzyme such as a peroxidase or a laccase, a hydrogen peroxide source and an enhancing agent represented by formula (I).

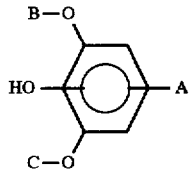

(I)

27 Claims, No Drawings

BLEACHING PROCESS COMPRISING USE OF PHENOL OXIDIZING ENZYME, A HYDROGEN PEROXIDE SOURCE AND AN ENHANCING AGENT

CROSS-REFERENCE TO RELATED APPLICATIONS

This application is a 35 U.S.C. 371 national application of PCT/DK95/00417 filed Oct. 18, 1995 and claims priority under 35 U.S.C. 119 of Danish application 1217/94 filed Oct. 20, 1994, the contents of which are fully incorporated herein by reference.

FIELD OF THE INVENTION

The present invention relates to a process for providing a bleached look in the colour density of the surface of dyed fabric, especially cellulosic fabric such as denim.

BACKGROUND ART

The most usual method of providing a bleached stone-washed look in denim fabric or jeans is by washing the denim or jeans made from such fabric in the presence of pumice stones to provide the desired localized lightening of the colour of the fabric. This is then followed by a bleaching process where the fabric is treated with sodium hypochlorite at 60° C. and pH 11–12 for up to 20 min., followed by a neutralisation step and a rinsing. Use of hypochlorite is undesirable, both because chlorite itself is undesirable and because the neutralisation subsequently generates high amounts of salts leading to disposal and pollution problems.

Bleaching enzymes such as peroxidases together with hydrogen peroxide or oxidases together with oxygen have also been suggested for bleaching of dyed textiles (see WO 92/18683), either alone or together with a phenol such as p-hydroxycinnamic acid, 2,4-dichlorophenol, p-hydroxybenzene sulphonate, vanillin or p-hydroxybenzoic acid. The disclosed process is not efficient as can be seen from Example 1 of the present invention.

Thus there is still a need for providing a bleached look in dyed fabrics. The problem to be solved is not easy as many VAT-dyes, especially indigo, are not soluble in water and have a very compact structure on the fibre surface, making them difficult for an enzyme to attack.

SUMMARY OF THE INVENTION

Surprisingly it has been found that it is possible to create a very efficient process for providing a bleached look in the colour density of the surface of dyed fabric, the process comprising contacting, in an aqueous medium, a dyed fabric with a phenol oxidizing enzyme system and an enhancing agent of the following formula:

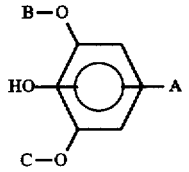

in which formula A is a group such as —D, —CH=CH—D, —CH=CH—CH=CH—D, —CH=N—D, —N=N—D, or —N=CH—D, in which D is selected from the group consisting of —CO—E, —$SO_2$—E, —N—XY, and —$N^+$—XYZ, in which E may be —H, —OH, —R, or —OR, and X and Y and Z may be identical or different and selected from —H and —R; R being a $C_1$–$C_{16}$ alkyl, preferably a $C_1$–$C_8$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$.

DETAILED DESCRIPTION OF THE INVENTION

Dyed Fabric

The process of the invention is most beneficially applied to cellulose-containing fabrics, such as cotton, iscose, rayon, ramie, linen, Tencel, or mixtures thereof, or mixtures of any of these fibres, or mixtures of any of these fibres together with synthetic fibres such as mixtures of cotton and spandex (stretch-denim). In particular, the fabric is denim. The process of the invention may also be applied to other natural materials such as silk.

The fabric may be dyed with vat dyes such as indigo, or indigo-related dyes such as thioindigo.

In a most preferred embodiment of the process of the invention, the fabric is indigo-dyed denim, including clothing items manufactured therefrom.

Phenol Oxidizing Enzyme Systems By the term "a phenol oxidizing enzyme system" is meant a system in which an enzyme, by using hydrogen peroxide or molecular oxygen, is capable of oxidizing organic compounds containing phenolic groups. Examples of such enzymes are peroxidases and oxidases.

If the phenol oxidizing enzyme system requires a source of hydrogen peroxide, the source may be hydrogen peroxide or a hydrogen peroxide precursor for in situ production of hydrogen peroxide, e.g. percarbonate or perborate, or a hydrogen peroxide generating enzyme system, e.g. an oxidase and a substrate for the oxidase, or an amino acid oxidase and a suitable amino acid, or a peroxycarboxylic acid or a salt thereof. Hydrogen peroxide may be added at the beginning of or during the process, e.g. in a concentration corresponding to 0.001-25 mM $H_2O_2$.

If the phenol oxidizing enzyme system requires molecular oxygen, molecular oxygen from the atmosphere will usually be present in sufficient quantity. The enzyme of the phenol oxidizing enzyme systems may be an enzyme exhibiting peroxidase activity or a laccase or a laccase related enzyme as described below.

According to the invention the concentration of the phenol oxidizing enzyme in the aqueous medium where the localized variation in the colour density of the surface of the dyed fabric is taking place, may be 0.001–10000 μg of enzyme protein per g denim, preferably 0.1–1000 μg of enzyme protein per g denim, more preferably 1–100 μg of enzyme protein per g denim.

Peroxidases and Compounds possessing Peroxidase Activity

Compounds possessing peroxidase activity may be any peroxidase enzyme comprised by the enzyme classification (EC 1.11.1.7), or any fragment derived therefrom, exhibiting peroxidase activity, or synthetic or semisynthetic derivatives thereof (e.g. porphyrin ring systems or microperoxidases, cf. e.g. US 4,077,768, EP 537,381, WO 91/05858 and WO 92/16634).

Preferably, the peroxidase employed in the method of the invention is producible by plants (e.g. horseradish or soybean peroxidase) or microorganisms such as fungi or bacteria. Some preferred fungi include strains belonging to the subdivision Deuteromycotina, class Hyphomycetes, e.g. Fusarium, Humicola, Tricoderma, Myrothecium, Verticillum, Arthromyces, Caldariomyces, Ulocladium, Embellisia, Cladosporium or Dreschlera, in particular *Fusarium oxysporun* (DSM 2672), *Humicola insolens, Trichoderma resii, Myrothecium verrucana* (IFO 6113), *Verticillum alboatrum, Verticillum dahlie, Arthromvces ramosus* (FERM P-7754), *Caldariomyces fumago, Ulocladium chartarum, Embellisia alli* or *Dreschlera halodes*.

Other preferred fungi include strains belonging to the subdivision Basidiomycotina, class Basidiomycetes, e.g. Coprinus, Phanerochaete, Coriolus or Trametes, in particular *Coprinus cinereus* f. microsporus (IFO 8371), *Coprinus macrorhizus, Phanerochaete chrysosporium* (e.g. NA-12) or Trametes (previously called Polyporus), e.g. *T. versicolor* (e.g. PR4 28-A).

Further preferred fungi include strains belonging to the subdivision Zygomycotina, class Mycoraceae, e.g. Rhizopus or Mucor, in particular *Mucor hiemalis*.

Some preferred bacteria include strains of the order Actinomycetales, e.g. *Streptomyces spheroides* (ATTC 23965), *Streptomyces thermoyiolaceus* (IFO 12382) or *Streptoverticillum verticillium* ssp. *verticillium*.

Other preferred bacteria include *Bacillus pumilus* (ATCC 12905), *Bacillus stearothermophilus, Rhodobacter sphaeroides, Rhodomonas palustri, Streptococcus lactis, Pseudomonas purrocinia* (ATCC 15958) or *Pseudomonas fluorescens* (NRRL B-11).

Further preferred bacteria include strains belonging to Myxococcus, e.g. *M. virescens*.

The peroxidase may furthermore be one which is producible by a method comprising cultivating a host cell transformed with a recombinant DNA vector which carries a DNA sequence encoding said peroxidase as well as DNA sequences encoding functions permitting the expression of the DNA sequence encoding the peroxidase, in a culture medium under conditions permitting the expression of the peroxidase and recovering the peroxidase from the culture.

Particularly, a recombinantly produced peroxidase is a peroxidase derived from a Coprinus sp., in particular *C. macrorhizus* or *C. cinereus* according to WO 92/16634, or a variant thereof, e.g., a variant as described in WO 94/12621.

In the context of this invention, peroxidase acting compounds comprise peroxidase active fragments derived from cytochromes, haemoglobin or peroxidase enzymes, and synthetic or semisynthetic derivatives thereof, e.g. iron porphins, iron porphyrins, and iron phthalocyanine and derivatives thereof.

Determination of Peroxidase activity: 1 peroxidase unit (PODU) is the amount of enzyme that catalyzes the conversion of 1 μmol hydrogen peroxide per minute at the following analytical conditions: 0.88 mM hydrogen peroxide, 1.67 mM 2,2'-azinobis(3-ethylbenzothiazoline-6-sulfonate), 0.1M phosphate buffer, pH 7.0, incubated at 30° C., photometrically followed at 418 nm.

Laccase and Laccase Related Enzymes

In the context of this invention, laccases and laccase related enzymes contemplate any laccase enzyme comprised by the enzyme classification (EC 1.10.3.2), any chatechol oxidase enzyme comprised by the enzyme classification (EC 1.10.3.1), any bilirubin oxidase enzyme comprised by the enzyme classification (EC 1.3.3.5) or any monophenol monooxygenase enzyme comprised by the enzyme classification (EC 1.14.99.1).

The laccase enzymes are known from microbial and plant origin. The microbial laccase enzyme may be derived from bacteria or fungi (including filamentous fungi and yeasts) and suitable examples include a laccase derivable from a strain of Aspergillus, Neurosnora, e.g. *N. crassa*, Podospora, Botrytis, Collybia, Fomes, Lentinus, Pleurotus, Trametes (previously called Polyporus), e.g. *T. villosa* and *T. versicolor*, Rhizoctonia, e.g. R. solani, Coprinus, e.g. *C. plicatilis* and *C. cinereus*, Psatyrella, Myceliophthora, e.g. *M. thermonhila*, Schytalidium, Phlebia, e.g., *P. radita* (WO 92/01046), or Coriolus, e.g. *C.hirsutus* (JP 2—238885).

The laccase or the laccase related enzyme may furthermore be one which is producible by a method comprising cultivating a host cell transformed with a recombinant DNA vector which carries a DNA sequence encoding said laccase as well as DNA sequences encoding functions permitting the expression of the DNA sequence encoding the laccase, in a culture medium under conditions permitting the expression of the laccase enzyme, and recovering the laccase from the culture.

Determination of Laccase Activity (LACU)

Laccase activity is determined from the oxidation of syringaldazin under aerobic conditions. The violet colour produced is photometered at 530 nm. The analytical conditions are 19 μM syringaldazin, 23.2 mM acetate buffer, pH 5.5, 30° C, 1 min. reaction time.

1 laccase unit (LACU) is the amount of enzyme that catalyses the conversion of 1.0 μmole syringaldazin per minute at these conditions.

Enhancing Agents

The enhancing agent used in the present invention may be described by the following formula:

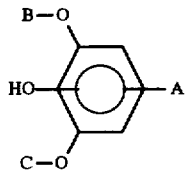

in which formula A is a group such as —D, —CH=CH—D, —CH=CH=CH=CH—D, —CH=N—D, —N=N—D, or —N=CH—D, in which D is selected from the group consisting of —CO—E, —$SO_2$—E, —N—XY, and —$N^+$—XYZ, in which E may be —H, —OH, —R, or —OR, and X and Y and Z may be identical or different and selected from —H and —R; R being a $C_1$–$c_{16}$ alkyl, preferably a $C_1$–$C_8$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$.

In a preferred embodiment A in the above mentioned formula is —CO—E, in which E may be —H, —OH, —R, or —OR; R being a $C_1$–$C_{16}$ alkyl, preferably a $C_1$–$C_8$ alkyl, which alkyl may be saturated or unsaturated, branched or unbranched and optionally substituted with a carboxy, sulfo or amino group; and B and C may be the same or different and selected from $C_mH_{2m+1}$; $1 \leqq m \leqq 5$.

In the above mentioned formula A may be placed meta to the hydroxy group instead of being placed in the para-position as shown.

In particular embodiments, the enhancing agent is acetosyringone, methylsyringate, ethylsyringate, propylsyringate, butylsyringate, hexylsyringate, or octylsyringate.

The enhancing agent of the invention may be present in concentrations of from 0.005–1000 μmole per g denim, referably 0.05–500 μmole per g denim, more preferably 0.5–100 μmole per g denim.

Stability of the Radical of the Enhancing Agent

Without being limited to any theory it is presently contemplated that there is a positive correlation between the half-life of the radical which the enhancing agent forms in the relevant aqueous medium and its efficiency in providing a bleached look in the colour density of the surface of the dyed fabric together with the phenol-oxidizing enzyme system, and that this half-life is significantly longer than the half-life of any of the substances selected from the group consisting of p-hydroxycinnamic acid, 2,4-dichlorophenol, p-hydroxybenzene sulphonate, vanillin and p-hydroxybenzoic acid (i.e. the enhancing agents disclosed in WO 92/18683).

This invention therefore further relates to a process for providing a bleached look in the colour density of the surface of dyed fabric, the process comprising contacting, in an aqueous medium, a dyed fabric with a phenol oxidizing enzyme system and an enhancing agent, wherein said enhancing agent is capable of forming a radical having a half-life, in said aqueous medium, which is at least 10 times longer than the radical half-life of any one of the substances selected from the group consisting of p-hydroxycinnamic acid, 2,4-dichlorophenol, p-hydroxybenzene sulphonate, vanillin and p-hydroxybenzoic acid, tested in the same aqueous medium, in particular wherein said enhancing agent is capable of forming a radical having a half-life, in said aqueous medium, which is at least 100 times longer than the radical half-life of any one of the substances selected from the group consisting of p-hydroxycinnamic acid, 2,4-dichlorophenol, p-hydroxybenzene sulphonate, vanillin and p-hydroxybenzoic acid, tested in the same aqueous medium.

As the half-life of the radical is dependent on, inter alia, the pH, the temperature and the buffer of the aqueous medium, it is very important that all these factors are the same when the half-lifes of the radicals of various enhancing agents are compared.

Industrial Applications

The process of the present invention is typically used in industrial machines for making fabric look bleached. Normally, the process of the invention will be performed on fabric already stonewashed, but the process may also be applied to fabric which has not undergone a stonewashing process beforehand. Most commonly the fabric is added to the machine according to the machine capacity per the manufacturer's instructions. The fabric may be added to the machine prior to introducing water or the fabric may be added after water is introduced. The phenol oxidizing enzyme system and the enhancing agent of the invention may be present in the water prior to adding the fabric or they may be added after the fabric has been wetted. The phenol oxidizing enzyme system may be added simultaneously with the enhancing agent or they may be added separately. After the fabric has been contacted with the phenol oxidizing enzyme system and the enhancing agent of the invention it should be agitated in the machine for a sufficient period of time to ensure that the fabric is fully wetted and to ensure the action of the enzyme system and the enhancing agent.

Absorbed Organic Halogens (AOX)

As a result of the chlorine-free bleaching process, AOX is expected to be significantly lower when the process according to the invention is used compared to the conventional hypochlorite based process.

Strength Loss

The enzyme/enhancing agent bleaching process of the present invention results in a very specific attack on indigo and it is therefore contemplated that the process does not result in a damage of the cotton, in particular no strength loss.

The invention is further illustrated in the following examples which are not intended to be in any way limiting to the scope of the invention as claimed.

EXAMPLE 1

The test procedure for denim bleaching was performed as described below:

Enhancing agents: Methylsyringate was obtained from Lancaster. Acetosyringone, p-hydroxybenzoic acid, p-hydroxy-benzene-sulfonate, 2,4-dichlorophenol, vanillin and p-hydroxycinnamic acid were obtained from Aldrich. Enzyme: Laccase derived from *Trametes villosa* (SP 504, available from Novo Nordisk A/S) was used.

Procedure: 18 ml 0.01 M B&R (Britt & Robinson) buffer (pH 4, 6, or 8) were added to a 50 ml conical flask. A magnet bar (4 cm) and a round piece of stone washed denim (3.5 cm diameter 0.4 g) were added to the flask together with 1 ml of the stock solution of the enhancing agent to be tested and 1 ml of enzyme, giving a denim:liquor (w/w) ratio of 1:50; the final concentrations of the enhancing agent and the enzyme shown in Table 1–5 below.

The flask was incubated for 3 hours on a magnet stirrer in a water bath (50° C. and approximately 200 rpm). After the enzymatic bleaching, the denim swatch was rinsed with distilled water and air dried, whereafter it was evaluated for the degree of bleaching. The evaluation was performed visually and by using a Minolta Chroma Meter CR200.

Evaluation: A Minolta Chroma Meter CR200 (available from Minolta Corp.) was used according to Manufacturer's instructions to evaluate the degree of bleaching as well as to estimate any discoloration using the change in the colour space coordinates L*a*b* (CIELAB—system): L gives the change in white/black at a scale of from 0 to 100, a gives the change in green (−a*)/red (+a*), and b gives the change in blue (−b*)/yellow (+b*) . A decrease in L* means an increase in black colour (decrease of white colour) , an increase in L* means an increase in white colour (a decrease in black colour) , a decrease in a* means an increase in green colour (decrease in red colour), an increase in a* means an increase in red colour (a decrease in green colour), a decrease in b* means an increase in blue colour (a decrease in yellow colour), and an increase in b* means an increase in yellow colour (a decrease in blue colour).

The bleached stone washed denim swatches were compared to non—treated stone washed swatches.

The Minolta Chroma Meter CR200 was operated in the L*a*b* coordinate system. The light source used was a CIE light standard C. Each measurement was an average of 3 measurements. The instrument was calibrated using a Minolta calibration plate (white). 10 non-treated denim swatches were measured 2 times each and the average of the coordinates L*a*b* were calculated and entered as a reference. The coordinates of the samples were then calculated as the difference (Δ) of the average of 3 measurements on each swatch from the reference value of the coordinates L*a*b*.

TABLE 1

Table 1 shows Δ (L*/a*/b*) between a swatch treated with the tested system (different concentrations of laccase and 1000 μM acetosyringone~50 μmole/g denim) and a non-treated swatch at pH 4.

| | 0 μM (0 μmole/g) | 10 μM (0.5 μmole/g) | 100 μM (5 μmole/g) | 1000 μM (50 μmole/g) |
|---|---|---|---|---|
| 0 LACU/ml | | | | 2.9/−0.5/0.4 |
| 0.1 LACU/ml (78 μg/g) | | | | |
| 1 LACU/ml (780 μg/g) | | | | 5.8/−1.1/2.0 |
| 5 LACU/ml (3900 μg/g) | | | | 6.3/−1.3/2.4 |

TABLE 2

Table 2 shows Δ (L*/a*/b*) bewteen a swatch treated with the tested system (different concentrations of laccase and acetosyringone) and a non-treated swatch at pH 6.

| | 0 μM | 10 μM (0.5 μmole/g) | 100 μM (5 μmole/g) | 1000 μM (50 μmole/g) |
|---|---|---|---|---|
| 0 LACU/ml | | | | 2.9/−0.5/−0.3<br>0.5/0.1/0.0 |
| 0.1 LACU/ml (78 μg/g) | | 0.3/0.3/0.1 | 7.0/−1.0/1.7 | 11.7/−2.3/4.0 |
| 1 LACU/ml (780 μg/g) | | 0.5/0.2/0.2 | 7.8/−1.0/1.7 | 15.3/−2.7/5.5<br>16.0/−2.7/5.9 |
| 5 LACU/ml (3900 μg/g) | | | | 19.2/−3.4/6.5 |

TABLE 3

Table 3 shows Δ (L*/a*/b*) between a swatch treated with the tested system (different concentrations of laccase and acetosyringone) and a non-treated swatch at pH 8.

| | 0 μM | 10 μM (0.5 μmole/g) | 100 μM (5 μmole/g) | 1000 μM (50 μmole/g) |
|---|---|---|---|---|
| 0 LACU/ml | | | | 1.7/0.0/0.5 |
| 0.1 LACU/ml (78 μg/g) | | 0.1/0.3/−0.3 | −0.5/0.4/−0.3 | 2.2/0.0/0.4 |

TABLE 3-continued

Table 3 shows Δ (L*/a*/b*) between a swatch treated with the tested system (different concentrations of laccase and acetosyringone) and a non-treated swatch at pH 8.

| | 0 μM | 10 μM (0.5 μmole/g) | 100 μM (5 μmole/g) | 1000 μM (50 μmole/g) |
|---|---|---|---|---|
| 1 LACU/ml (780 μg/g) | | −1.0/0.5/0.3 | 4.1/−0.6/2.2 | 4.1/−0.6/2.2 |
| 5 LACU/ml (3900 μg/g) | | | | |

TABLE 4

Table 4 shows Δ (L*/a*/b*) between a swatch treated with 1000 μM methylsyringate (~50 μmole/g) and laccase (1.0 LACU/ml ~780 μg/g) and a non-treated swatch at pH 4, 6 and 8.

| | pH 4 | pH 6 | pH 8 |
|---|---|---|---|
| Methyl syringate: | 8.2/−1.3/1.6 | 22.2/−3.2/6.6 | 4.5/−0.8/0.5 |
| (1000 μM~ 50 μmole/g) Laccase: | | | |
| (1.0 LACU/ml~ 780 μg/g) | | | |

Visually a ΔL around 5 gives a significant effect so it can be seen from the results presented in Table 1–4 that acetosyringone and methylsyringate at pH 6 have a significant effect in bleaching denim.

TABLE 5

Table 5 shows Δ (L*/a*/b*) between a swatch treated with the enhancing agents described in WO 92/18683 + laccase (0.1–1.0 LACU/ml corresponding to 78 μg enzyme protein/g denim-780 μg enzyme protein/g denim) and a non-treated swatch at pH 4, 6 and 8.

| Tested System | pH 4 | pH 6 | pH 8 |
|---|---|---|---|
| p-Hydroxy-benzoic acid: | 0.85/ −0.09/ | 0.91/ −0.19/ | −0.21/ 0.24/ |
| (1000 μM~ 50 μmole/g) Laccase: | 0.61 | −0.14 | −0.17 |
| (0.1 LACU/ml ~78 μg/g) | | | |
| p-Hydroxy-benzene-sulfonate: | −0.18/ 0.14/ −0.12 | 0.33/ 0.06/ −0.22 | −0.51/ 0.17/ −0.20 |
| (1000 μM~ 50 μmole/g) Laccase: | | | |
| (0.1 LACU/ml ~78 μg/g) | | | |
| 2,4-Dichloro-phenol: | 0.64/ −0.22/ | −0.19/ −0.19/ | −0.54/ 0.16/ |
| (1000 μM~ 50 μmole/g) | 0.5 | 0.57 | −0.14 |

TABLE 5-continued

Table 5 shows Δ (L*/a*/b*) between a swatch treated with the enhancing agents described in WO 92/18683 + laccase (0.1–1.0 LACU/ml corresponding to 78 μg enzyme protein/g denim-780 μg enzyme protein/g denim) and a non-treated swatch at pH 4, 6 and 8.

| Tested System | pH 4 | pH 6 | pH 8 |
|---|---|---|---|
| Laccase: | | | |
| (0.1 LACU/ml ~78 μg/g) | | | |
| Vanillin: | –0.67/ | 0.28/ | –0.38/ |
| (1000 μM~ 50 μmole/g) | –0.34/ 1.41 | –0.03/ 0.49 | –0.05/ 0.75 |
| Laccase: | | | |
| (1.0 LACU/ml ~780 μg/g) | | | |
| p-Hydroxy-cinnamic acid: | 0.64/ –0.53/ 1.62 | 4.47/ –0.63/ 3.88 | 2.97/ –0.45/ 0.79 |
| (1000 μM~ 50 μmole/g) | | | |
| Laccase: | | | |
| (1.0 LACU/ml~ 780 μg/g) | | | |

From the results presented in Table 5 it can be seen that none of the prior art described enhancing agents have any significant effect in bleaching the denim.

EXAMPLE 2

Comparison of performance in different buffers

Denim bleaching using methyl syringate (MS) was compared in the following 3 buffers: Phosphate, oxalate, and acetate, all 0.01 M, prepared from $Na_2HPO_4 \times 2H_2O$ (pH adjusted with sulphuric acid), $Na_2$-oxalate (pH adjusted with sulphuric acid), and Na-acetatex$3H_2O$ (pH adjusted with sulphuric acid) respectively. Each buffer was prepared at pH 4.0, 5.0, 6.0, and 7.0 respectively.

300 ml of the buffer in question was added to a 1200 ml (total volume) stainless steel beaker together with 1 piece of stone washed denim weighing approximately 12 g (denim:liqour ratio=1:25); 1 ml of a 15 g/l MS (obtained from Lancaster) in 96% ethanol stock solution was added to each beaker (corresponding to 236 μM or 5.9 μmole MS/g denim) together with 0.132 ml of a 114 LACU/ml laccase stock solution (corresponding to 0.05 LACU/ml or 19.5 μg enzyme protein/g denim). The laccase was derived from *Trametes villosa* (TvL) and available from Novo Nordisk A/S (SP 504).

The beakers were closed and processed at 60° C. for 30 minutes in a Atlas LP2 launder—ometer. Following processing, the denim swatches were rinsed in distilled water and air dried over—night, and the final pH of the bleaching liquor was measured.

When dry, the degree of bleaching of the denim was determined measuring the absolute L*a*b* coordinates (average of 6 measurements) of the bleached denim as well as of the starting material from which Δ(L*a*b*) was calculated. The results obtained are shown in Table 6 below.

TABLE 6

| $pH_{start}$ | $pH_{end}$ | ΔL* | Δa* | Δb* |
|---|---|---|---|---|
| | | 0.01 M phosphate buffer | | |
| 4.0 | 5.2 | 4.56 | –0.71 | 1.24 |
| 5.0 | 5.3 | 6.11 | –0.99 | 1.07 |
| 6.0 | 6.1 | 7.42 | –1.37 | 0.74 |
| 7.0 | 7.0 | 0.16 | 0.04 | 0.20 |
| | | 0.01 M oxalate buffer | | |
| 4.0 | 4.1 | 2.43 | –0.28 | 0.44 |
| 5.0 | 5.3 | 6.40 | –1.06 | 1.11 |
| 6.0 | 7.0 | 2.63 | –0.38 | 0.81 |
| 7.0 | 7.7 | 1.44 | –0.20 | 0.56 |
| | | 0.01 M acetate buffer | | |
| 4.0 | 4.0 | 1.32 | –0.27 | 0.46 |
| 5.0 | 5.0 | 4.96 | –0.83 | 1.42 |
| 6.0 | 6.4 | 6.66 | –1.26 | 0.90 |
| 7.0 | 7.4 | 0.89 | 0.00 | 0.39 |

From Table 6 it is seen, that there is no major influence on the bleaching process of the choice of buffer, besides the effect arising from the drift in pH in the various buffers due to the poor buffer capacity of some of the buffers at some of the pH investigated. Further it is seen, that pH optimum lies in the range pH of 5.5–6.5, which is in accordance with the results obtained in Example 1, Table 4.

EXAMPLE 3

Investigation of effect of varying concentration of methyl syringate (MS) and laccase Denim bleaching using MS and 0.01 M phosphate buffer (prepared from $Na_2HPO_4 \times 2H_2O$, pH adjusted with sulphuric acid) was compared in the pH range 5.0–6.5 for various dosages of MS and laccase.

300 ml of buffer was added to a 1200 ml (total volume) stain-less steel beaker together with 1 piece of stone washed denim weighing approximately 12 g (denim:liqour ratio=1:25), and 1 or 2 ml of a 15 g/l MS (obtained from Lancaster) in 96% ethanol stock solution was added to each beaker (corresponding to 236 μM=5.9 μmole MS/g denim or 472 μM=11.8 μmole MS/g denim) together with 0.132 or 0.264 ml of a 114 LACU/ml laccase stock solution (corresponding to 0.05 LACU/ml=19.5 μg enzyme protein/g denim or 0.10 LACU/ml=39 μg enzyme protein/g denim). The laccase was derived from *Trametes villosa* (TvL) and available from Novo Nordisk A/S (SP 504).

The beakers were closed and processed at 60° C. for 30 minutes in a Atlas LP2 launder-ometer. Following processing, the denim swatches were rinsed in distilled water and air dried overnight, and the final pH of the bleaching liquor was measured.

When dry, the degree of bleaching of the denim was determined measuring the absolute L*a*b* coordinates (average of 6 measurements) of the bleached denim as well as of the starting material from which Δ(L*a*b*) was calculated. The results obtained are shown in Table 7 below.

TABLE 7

| | $pH_{start}$ | $pH_{end}$ | ΔL* | Δa* | Δb* |
|---|---|---|---|---|---|
| 236 μM MS = 5.9 | 5.0 | 5.6 | 5.18 | −0.88 | 1.10 |
| μmole MS/g denim | 5.5 | 5.8 | 5.44 | −1.03 | 0.94 |
| 0.05 LACU/ml = 12.5 | 6.0 | 6.2 | 6.24 | −1.13 | 0.78 |
| μg enzyme protein/g | 6.5 | 6.6 | 3.43 | −0.67 | 0.52 |
| denim | | | | | |
| 472 μM MS = 11.8 | 5.0 | 5.7 | 6.76 | −1.20 | 1.34 |
| μmole MS/g denim | 5.5 | 5.9 | 6.93 | −1.17 | 1.50 |
| 0.05 LACU/ml = 12.5 | 6.0 | 6.1 | 6.92 | −1.28 | 0.97 |
| μg enzyme protein/g | 6.5 | 6.6 | 6.14 | −1.07 | 0.69 |
| denim | | | | | |
| 236 μM MS = 5.9 | 5.0 | 5.6 | 7.87 | 1.46 | 1.08 |
| μmole MS/g denim | 5.5 | 5.8 | 7.56 | −1.45 | 0.90 |
| 0.1 LACU/ml = 25 μg | 6.0 | 6.1 | 6.89 | −1.35 | 0.75 |
| enzyme protein/g | 6.5 | 6.5 | 6.15 | −1.11 | 0.46 |
| denim | | | | | |
| 472 μM MS = 11.8 | 5.0 | 5.6 | 5.82 | −0.96 | 1.13 |
| μmole MS/g denim | 5.5 | 5.8 | 7.32 | −1.37 | 1.12 |
| 0.1 LACU/ml = 25 μg | 6.0 | 6.1 | 7.04 | −1.34 | 0.83 |
| enzyme protein/g | 6.5 | 6.6 | 6.24 | −1.07 | 0.71 |
| denim | | | | | |

From Table 7 it is seen, that increasing the concentration of either MS or laccase increases bleaching. Further, pH optimum is in the range 5.5–6.0.

EXAMPLE 4

Denim bleaching using various enhancers

Enhancing agents: The enhancing agents were obtained from Lancaster (methylsyringate), Aldrich (acetosyringone), or were synthesized as described in Chem. Ber. 67, 1934, p. 67.

Enzyme: Laccase derived from *Trametes villosa* (SP 504, available from Novo Nordisk A/S) was used.

Procedure: 18 ml 0.01 M B&R (Britt & Robinson) buffer pH 4.0, pH 6.0, or pH 8.0 were added to a 50 ml conical flask. A magnet bar (4 cm), and a round piece of stone washed denim (3.5 cm in diameter=0.4 g denim) were added to the flask together with 1 ml of the stock solution of the enhancing agent to be tested (0.02 M in 96% ethanol) and 1 ml of enzyme stock solution (20 LACU/ml).

Summarizing the conditions used:

Denim:liquor ratio=1:50, 1.0 LACU/ml=780 μg enzyme protein/g denim, 1000 μM~50 μmole enhancing agent/g denim.

The flasks were incubated for 3 hours on a magnet stirrer in a water bath (50° C. and approximately 200 rpm). After the enzymatic bleaching, the denim swatch was rinsed with water and dried in an oven at approximately 110° C. for 15 minutes, whereafter it was evaluated for the degree of bleaching. The evaluation was performed according to the procedure mentioned in Example 1.

TABLE 8

Table 8 shows Δ (L*a*b*) between a swatch treated with the tested system, and a non-treated swatch. Conditions: 0.01 M B&R buffer pH 4.0, pH 6.0, or pH 8.0, denim:liquor ratio = 1:50, 1.0 LACU/ml = 780 μg enzyme protein/g denim, 1000 μM~50 μmole enhancing agent/g denim. The flasks were incubated for 3 hours on a magnet stirrer in a water bath (50° C. and approximately 200 rpm).

| Enhancer | pH 4.0 | pH 6.0 | pH 8.0 |
|---|---|---|---|
| Methyl-syringate | 3.9/−1.0/2.1 | 22.4/−4.3/5.7 | 2.0/−0.3/−0.0 |
| Ethyl-syringate | 7.6/−1.5/2.9 | 19.1/−3.6/5.8 | 1.2/0.1/−0.0 |
| Propyl-syringate | 7.7/−1.7/3.2 | 20.9/−3.7/6.9 | 3.5/−0.4/1.2 |
| Butyl-syringate | 11.1/−2.7/4.7 | 18.5/−3.6/7.1 | 1.3/−0.2/0.7 |
| Hexyl-syringate | 9.3/−2.2/4.1 | 7.8/−1.9/3.1 | 0.3/0.1/0.5 |
| Octyl-syringate | 8.2/−1.7/4.0 | 4.5/−1.4/2.9 | 1.8/−0.3/0.7 |
| Aceto-syringone | 7.5/−1.8/4.5 | 17.9/−4.1/5.6 | 0.4/−0.2/1.1 |

We claim:

1. A process for providing a bleached look in the colour density of the surface of dyed fabric, the process comprising contacting, in an aqueous medium, a dyed fabric with a phenol oxidizing enzyme system and an enhancing agent of the following formula:

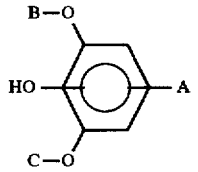

(I)

in which A is selected from the group consisting of —D, —CH=CH—D, —CH=CH=CH—CH—D, —CH=N—D, —N=N—D, and —N=CH—D, in which D is selected from the group consisting of —CO—E, —$SO_2$—E, —N—XY, and —N+XYZ, in which E is selected from the group consisting of—H, —OH, —R, or —OR, and X, Y, and Z are selected from the group consisting of —H and —R in which R is a $C_1$–$C_{16}$ alkyl, which is optionally substituted with a carboxy, sulfo or amino group; and B and C is $C_mH_{2m+1}$, in which $1 \leqq m \leqq 5$.

2. The process according to claim 1, wherein X, Y, and Z are identical.

3. The process according to claim 1, wherein X,Y, and X are different.

4. The process according to claim 1, wherein R is a $KC_1$–$C_8$ alkyl.

5. The process according to claim 1, wherein R is a saturated $C_1$–$C_{16}$ alkly.

6. The process according to claim 1, wherein R is a nonsaturated $C_2$–$C_{16}$ alkyl.

7. The process according to claim 1, wherein R is a branched $C_1$–$C_{16}$ alkyl.

8. The process according to claim 1, wherein R is an nonbranched $C_1$–$C_{16}$ alkyl.

9. The process according to claim 1, wherein B and C are the same.

10. The process according to claim 1, wherein B and C are different.

11. The process according to claim 1, wherein the fabric is dyed with a vat dye.

12. The process according to claim 1, wherein the fabric is dyed with a vat dye selected from the group consisting of indigo and thioindigo.

13. The process according to claim 1, wherein the fabric is a cellulosic fabric or a mixture of cellulosic fibres or a mixture of cellulosic fibres and synthetic fibres.

14. The process according to claim 1, wherein the fabric is denim.

15. The process according to claim 14, wherein the concentration of the phenol oxidizing enzyme corresponds to 0.001–10000 μg of enzyme protein per g of denim.

16. The process according to claim 14, wherein the enhancing agent in the aqueous medium is present in a concentration of from 0.005 to 1000 μmole per g denim.

17. The process according to claim 1, wherein the fabric is denim dyed with indigo or thioindigo.

18. The process according to claim 1, wherein the phenol oxidizing enzyme system is a peroxidase and a hydrogen peroxide source.

19. The process according to claim 18, wherein the peroxidase is horseradish peroxidase, soybean peroxidase or a peroxidase enzyme derived from Coprinus, Bacillus, or Mvxococcus.

20. The method according to claim 18, wherein the hydrogen peroxide source is hydrogen peroxide or a hydrogen peroxide precursor, a hydrogen peroxide generating enzyme system, or a peroxycarboxylic acid or a salt thereof.

21. The method according to claim 18, wherein the hydrogen peroxide source is perborate, percarbonate, or an oxidase and its substrate.

22. The process according to claim 1, wherein the phenol oxidizing system is a peroxidase is derived from *Coprinus cinereus, Coprinus macrorhizus, Bacillus pumilus,* or *Myxococcus virescens.*

23. The method according to claims 1, wherein the aqueous medium contains $H_2O_2$ or a precursor for $H_2O_2$ in a concentration corresponding to 0.001–25 mM $H_2O_2$.

24. The process according to claim 1, in which the phenol oxidizing enzyme system is a laccase or a laccase related enzyme together with oxygen.

25. The process according to claim 24, wherein the laccase is derived from Trametes, Coprinus, or Myceliophthora.

26. The process according to claim 24, wherein the laccase is derived from *Trametes villosa, Coprinus cinereus,* or *Myceliophthora thermophila.*

27. The process according to claim 1, wherein the enhancing agent is selected from the group consisting of acetosyringone, methylsyringate, ethylsyringate, propylsyringate, butylsyringate, hexylsyringate, and octylsyringate.

* * * * *